US007533552B2

(12) United States Patent
Mancini

(10) Patent No.: US 7,533,552 B2
(45) Date of Patent: May 19, 2009

(54) SYSTEM FOR THE PRODUCTION OF EXTRUDED ALUMINUM PROFILES

(75) Inventor: Bruno Mancini, Rodengo Saiano (IT)

(73) Assignee: Cometal Engineering S.p.A., Rodengo Saiano (Brescia) (IT)

( * ) Notice: Subject to any disclaimer, the term of this patent is extended or adjusted under 35 U.S.C. 154(b) by 92 days.

(21) Appl. No.: 11/661,163

(22) PCT Filed: Jan. 21, 2005

(86) PCT No.: PCT/IT2005/000030

§ 371 (c)(1),
(2), (4) Date: Feb. 22, 2007

(87) PCT Pub. No.: WO2005/070577

PCT Pub. Date: Aug. 4, 2005

(65) Prior Publication Data

US 2008/0127701 A1 Jun. 5, 2008

(30) Foreign Application Priority Data

Jan. 22, 2004 (IT) ..... BS2004A0009

(51) Int. Cl.
*B21C 23/00* (2006.01)
*B21C 35/00* (2006.01)
*B21C 23/24* (2006.01)

(52) U.S. Cl. ..... 72/257; 72/256; 72/46

(58) Field of Classification Search ..... 72/254, 72/256, 257, 342.2, 342.5, 46
See application file for complete search history.

(56) References Cited

U.S. PATENT DOCUMENTS 3,339,395 A * 9/1967 Winstrom ..... 72/257
4,495,001 A * 1/1985 Bennett et al. ..... 148/690
5,802,905 A * 9/1998 Biswas et al. ..... 72/270

FOREIGN PATENT DOCUMENTS

GB 2230723 10/1990
JP 62224662 10/1987
JP 01025958 1/1989

* cited by examiner

*Primary Examiner*—Dana Ross
*Assistant Examiner*—Teresa Bonk
(74) *Attorney, Agent, or Firm*—Andrew Wilford

(57) ABSTRACT

A system for the production of extruded aluminum or aluminum alloy profiles starting with billets has an extrusion press having a horizontally directed outlet and to which is fed preheated billets press such that the billets exit the outlet of press as a horizontally extending profile that is fed horizontal to a horizontal bench where, while still horizontal, the provides are cooled, straightened, and cut into profile sections. A conditioning chamber for profile ageing heat treatment downstream of the bench as well as a device for coating the profile sections. A device upstream of the conditioning chamber picks the profile sections up off the bench and shifts them from the horizontal orientation to a vertical orientation. An overhead conveyor extends from the picking-up device through the conditioning chamber and coating device for conveying the profile sections therethrough while in the vertical orientation.

4 Claims, 2 Drawing Sheets

SYSTEM FOR THE PRODUCTION OF EXTRUDED ALUMINUM PROFILES

CROSS REFERENCE TO RELATED APPLICATIONS

This application is the US national phase of PCT application PCT/IT/2005/000030, filed 21 Jan. 2005, published 4 Aug. 2005 as WO2005/070577, and claiming the priority of Italian patent application BS2004A000009 itself filed 22 Jan. 2004, whose entire disclosures are herewith incorporated by reference.

FIELD OF THE INVENTION

This invention refers to plants for the production of extruded aluminum or aluminum alloy profiles, and in particular it relates to an innovative process for the artificial ageing of extruded profiles in such plants.

STATE OF THE ART

Typically, a plant for the extrusion of aluminum or aluminum alloy profiles comprises a feeding and oven preheating system for the initial billets, a means for loading the preheated billets into an extrusion press and, at the outlet of this press, a line for the reception of the extruded profiles followed by a bench for cooling, straightening (stretching) and cutting the profiles to size.

Then, once cut, the profiles are grouped together side by side on support tables or in baskets and conveyed to an ageing chamber or tunnel where they stay at a preset temperature and for a preset time for a heat treatment so their molecular structure can stabilize and the extruded metal can attain certain mechanical characteristics.

After this treatment, the profiles are recovered and conveyed to other processes such as anodizing and coating or other mechanical operations. Alternately the profiles can be arranged for shipment in baskets or for storage in a warehouse.

In any case, on both the cooling, straightening and cutting bench and in all stages during their conveyance, including treatment in the ageing chamber, the extruded profiles are arranged horizontally. This arrangement of the profiles in the ageing chamber, in some plants, implies the drawbacks which may recognized as follow:

- discontinuous handling of profiles, albeit in containers and horizontally and with the possibility of the profiles bending,
- handling of profiles in layers with need to separate the different profile layers,
- difficulty in performing ageing with so-called "First-in, First-out" cycles,
- lack of continuity with subsequent processes without further intervention on the profiles,
- difficulty in using existing spaces in defining the arrangement (lay-out) of the equipment,
- need for large spaces for the transit of packs of profiles arranged horizontally.

In actual fact, in some other plants, profile handling can be continuous and done without using containers, and with the possibility of ageing with "First-in, First-out" cycles, but always horizontally and in layers and therefore with the same drawbacks mentioned earlier due to the horizontal position of the profiles.

OBJECT AND SUMMARY OF THE INVENTION

The object of this invention is instead to obviate at least the aforementioned drawbacks and, correspondingly, to improve plants for the extrusion of aluminum profiles at the level of the chamber for profile ageing treatment.

The object is attained according to the invention by means of a plant in which the extruded profiles, after the cooling, straightening and cutting to size processes, are taken and hung at one end on a conveyer system and conveyed through the ageing chamber in this vertical position. The attained advantages are:

- a better use of space in terms of height at the ageing chamber,
- easier conveyance of the profiles in said chamber including along paths that are not straight to reduce overall dimensions and better control temperatures and treatment times,
- continuous movement of the vertical profiles without the need for containers,
- individual handling of the profiles, without having to separate them and with the possibility of differentiated treatment and in "First-in, First-out" cycles in sequence,
- the possibility of also treating profiles of different lengths and sections all together,
- continuity with subsequent processes.

BRIEF DESCRIPTION OF DRAWINGS

The invention will be better illustrated in detail in the following description making reference to the enclosed indicative and not restrictive drawings, in which.

DETAILED DESCRIPTION OF THE INVENTION

Figure 1:
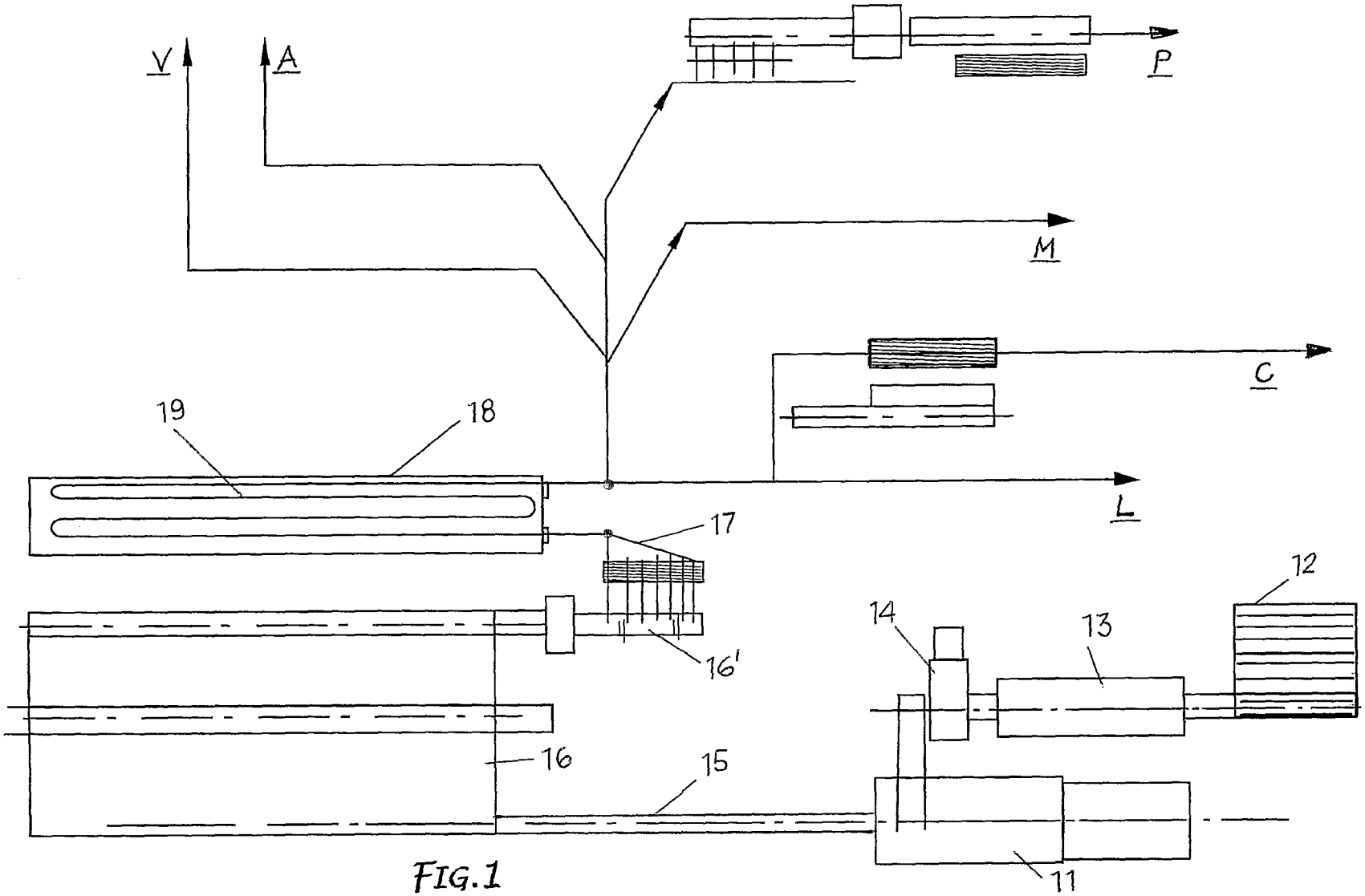
FIG. 1 schematically shows, in plane, a general view of an extrusion plant.

The plant shown comprises an extrusion press 11 to which are associated, upstream, a billet feeder 12, a billet pre-heating oven 13 and a device 14 for transferring the preheated billets from the oven to the press. In line with the outlet of the extrusion press 11 is a plane 15 for receiving the extruded profiles, followed by a bench 16 on which the profiles 17 are consecutively cooled and straightened and then cut to size, according to need, on a specific cutting bench 16'.

The profiles 17 then continue toward a conditioning chamber 18 for artificial ageing treatment at a controlled temperature and for a preset time.

In accordance with the invention, at the entrance to the chamber 18 for this treatment the profiles, which are in horizontal positions on the benches 16, 16' are picked up, turned vertically and hung on an overhead conveyor system 19 with one or more parallel lines and conveyed in this position into said treatment chamber 18.

Figure 2:
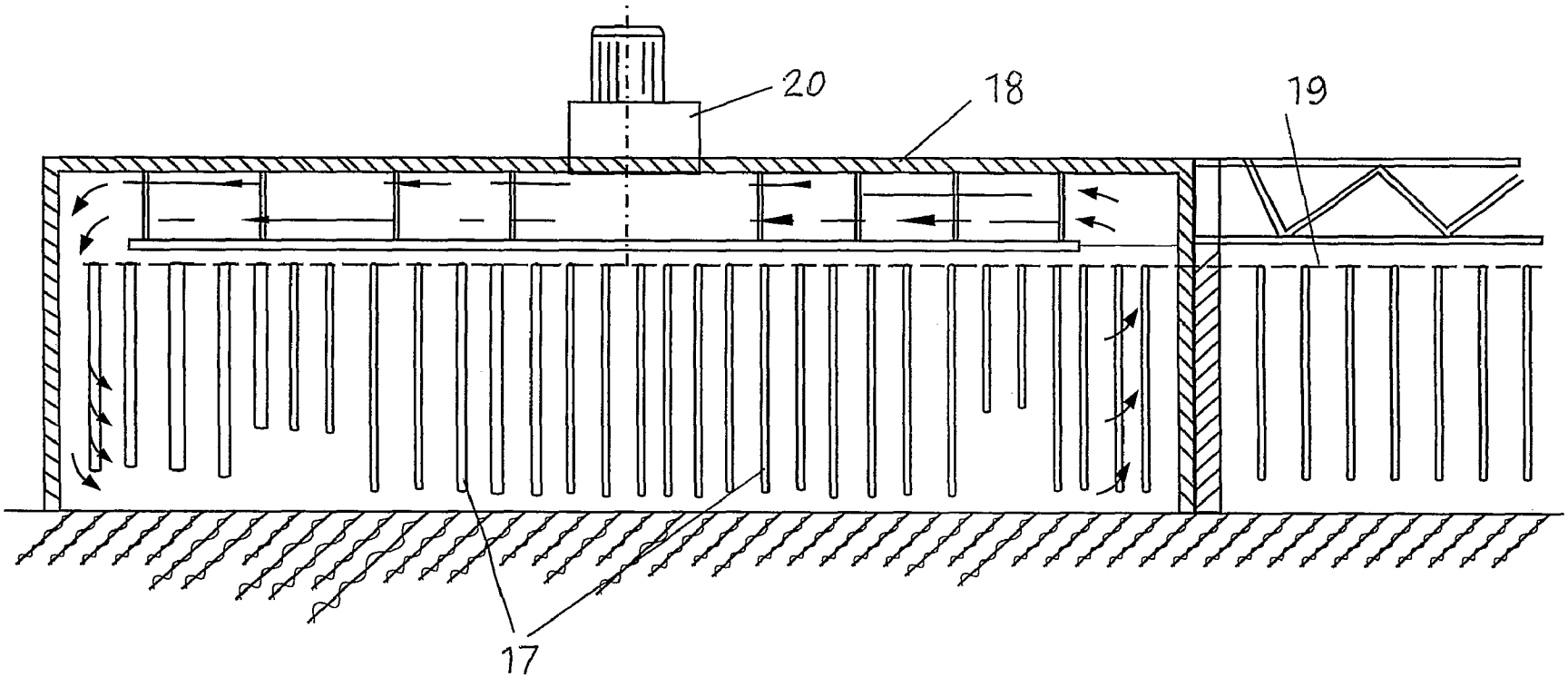
FIG. 2 shows a front sectional view of the profile heat treatment chamber for their artificial ageing.

This chamber is represented by an oven with an appropriate air-circulation heating system 20 (see FIG. 2). The conveyor system 19 can move in a straight line but more preferably in a zig-zag fashion (see FIG. 1), possibly with the chamber compartments controlled at different temperatures.

At the outlet of the treatment chamber 18, the profiles can be transferred, always maintaining vertical positions, to a subsequent anodizing or coating system according to respective lines A and V in FIG. 1. Otherwise, the profiles can be repositioned horizontally and sent for other machining operations L, or to a warehouse M or collected in a basket C or in a pack P for shipment.

The invention claimed is:

1. A system for the production of extruded aluminum or aluminum alloy profiles starting with billets, the system comprising;

an extrusion press having a horizontally directed outlet;

means for feeding preheated billets to the press such that the billets exit the outlet of press as a horizontally extending profile;

a horizontal profile cooling, straightening, and cutting bench downstream of the outlet;

means for conveying the profile in a horizontal orientation to and setting the profile in the horizontal orientation on the bench, whereby the profile is cooled, straightened, and cut into profile sections on the bench while horizontal;

a conditioning chamber for profile ageing heat treatment downstream of the bench;

means for coating the profile sections downstream of the conditioning chamber;

means upstream of the conditioning chamber for picking the profile sections up off the bench and shifting them from the horizontal orientation to a vertical orientation; and conveyor means extending from the picking-up means through the conditioning chamber and coating means for conveying the profile sections therethrough while in the vertical orientation.

2. The system for the production of extruded aluminum or aluminum alloy profiles according to claim 1 wherein the conditioning chamber consists of an oven and the overhead conveyor apparatus is straight or zig-zag, the chamber being split into compartments with diversified heating.

3. The system defined in claim 1 wherein the conveyor means extends overhead through the conditioning chamber and coating means and the profile sections hang individually from the conveyor means.

4. The system defined in claim 1 wherein the coating station anodizes the profile sections.

* * * * *